US005160086A

United States Patent [19]

Kuykendal et al.

[11] Patent Number: 5,160,086

[45] Date of Patent: Nov. 3, 1992

[54] LIGHTED LAMINAR FLOW NOZZLE

[76] Inventors: Robert L. Kuykendal, 3435 Hawthorne, St. Louis, Mo. 63104; David R. Usher, 118 Oakwood, St. Louis, Mo. 63119; Ronald S. Deichmann, 6040 Circle Dr., House Springs, Mo. 63051

[21] Appl. No.: 577,491

[22] Filed: Sep. 4, 1990

[51] Int. Cl.[5] ..... F21P 7/00; B05B 1/10

[52] U.S. Cl. ..... 239/18; 239/273; 239/589; 239/590

[58] Field of Search ..... 239/288–288.5, 239/264, 10–22, 273, 264, 265, 590.58, 590.589, 596, 601; 248/562, 617, 638; 417/540

[56] References Cited

U.S. PATENT DOCUMENTS

| | | | |
|---|---|---|---|
| 1,839,994 | 1/1932 | Proffatt | 239/18 |
| 2,034,792 | 3/1936 | Bergman | 239/18 |
| 2,924,394 | 2/1960 | Clark | 239/288.5 X |
| 3,510,065 | 5/1970 | Gigantino et al. | 239/590 |
| 3,632,049 | 1/1972 | Wenters | 239/590 |
| 3,874,417 | 4/1975 | Clay | 417/540 X |
| 4,002,293 | 1/1977 | Simmons | 239/17 X |
| 4,355,762 | 10/1982 | Coleman | 239/590.5 X |
| 4,607,794 | 8/1986 | Horwood | 239/601 X |

FOREIGN PATENT DOCUMENTS

| | | | |
|---|---|---|---|
| 342908 | 11/1959 | Switzerland | 239/18 |

*Primary Examiner*—Andres Kashnikow
*Assistant Examiner*—Kevin P. Weldon

[57] ABSTRACT

A lighted laminar-flow fluid nozzle is provided for use in decorative water fountains and industrial applications which defines fluid flow through a double-walled, bladder-like fluid supply hose, into a fluid chamber and through a diffuser, past trapped air pockets and exiting through a knife-edged outlet orifice. The fluid nozzle is mounted upon one or more stages of vibration dampening springs and the outlet orifice is located off center from the walls of the fluid chamber, all so that pump surges and vibrations are greatly dampened and the output fluid stream is sufficiently highly laminar so that light is conducted through the length of the output fluid stream in the manner of a fiber optic cable.

4 Claims, 3 Drawing Sheets

LIGHTED LAMINAR FLOW NOZZLE

BACKGROUND—FIELD OF INVENTION

This invention relates to fluid flow devices, particularly to that class of fluid nozzles which create a laminar discharge stream and it relates, as well, to the field of illuminated fluid nozzles.

BACKGROUND—DESCRIPTION OF PRIOR ART

Attractive water fountain displays have been important to mankind since ancient times. Only recently, however has much effort been aimed at carefully controlling the quality of the streams to achieve especially pleasing effects. Likewise, various external means have been applied to lighting to these fountains until Profatt. U.S. Pat. No. 1,839,994 first applied the light source to effectively light the stream from the inside. It was our objective, in developing the present invention, to make various advances in the development of laminar flow nozzle technology and especially, to combine the advantages of laminar flow technology with Proffat's internal lighting technique to create an effect whereby the stream of water, or other fluid, would transmit the light in a manner quite similar to a fiber optic cable. That is, the light would remain captured within the stream, repeatedly striking the outer surface at a low angle of incidence and being reflected back in with little loss of intensity. Since little light would be escaping from the fluid stream, it would not necessarily appear to be visibly lighted—until the stream is made to strike some object, at which occurrence the light would strike the object at the same spot and result in a brilliant and attractive display. However, we found that currently known laminar flow nozzle designs always allowed some noticeable measure of turbulence in the output streams. The effect of this turbulence always was to create ripples and imperfections in the outer surface of the fluid stream which allowed light to escape and resulted in showing the stream to be visibly lighted to an observer, and in diminished intensity upon the target object. It was necessary, then, for us to develop several distinct improvements to the design of laminar flow nozzles in order to achieve the desired effect. The result was a striking and beautiful effect, never before achieved, whereby an object can be seen to become brightly and colorfully lighted when it is struck by the glass-like fluid stream, which does not, itself, appear to lighted at all.

Previous efforts to embed a beam of light into a fluid stream produced the attractive effect of a stream that was noticeably lighted for most of its length. No previous art combines names for internally lighting a stream of fluid with more than minimal efforts to make the stream laminar. For example, Proffatt, U.S. Pat. No. 1,839,994 teaches a lighted, barrel shaped nozzle body and an orifice or series of orifices through a thin metal plate, while Kessener, U.S. Pat. No. 4,749,126 claims a "substantially non-turbulent liquid medium" while his description teaches an almost total lack of turbulence reducing means in his nozzle designs. The stream that they would produce would, in fact, be highly turbulent. In U.S. Pat. Nos. 4,749,126 and 4,901,922, Kessener seems to claim the means for any internally lighted nozzle design of exactly the type taught by Proffat, op. cit., in 1932. Other previous efforts to produce a lighted stream of water likewise seem to show little or no emphasis on minimizing turbulence in order to increase the dramatic effect. Examples of prior devices for producing a lighted, but turbulent, stream are U.S. Pat. Nos. 3,866,832; 1,839,994; 2,034,792; 2,623,367; 3,702,172; and 1,626,037 and Swiss patent number 342908, Trucco. Prior efforts to reduce the turbulence in a stream of fluid are shown in U.S. Pat. Nos. 2,432,641; 4,119,276; 3,851,825; 3,630,444; 3,730,439; 4,393,991; 3,321,140; 2,054,964; 2,408,588; 3,730,440; 3,874,417. Fuller, U.S. Pat. No. 4,795,092 teaches a laminar flow nozzle which, if it were combined with Proffatt's nozzle lighting technique might be a distinct improvement over the prior art. However, when light is applied through such a nozzle, the light is still visible, essentially over the length of the stream due to turbulence resulting from minute pressure variations generated within the pump, "pump noise", supplying fluid to the nozzle; and from minute vibrations transferred to the nozzle from indoor floor vibrations or outdoor passing traffic. Fuller's "flow straightening devices" and "tangential input port" produce a pleasing effect but appear to be neither necessary nor sufficient for reducing turbulence enough for the desired lighted nozzle effect.

OBJECTS AND ADVANTAGES

It is the object of this invention to create a nozzle method and apparatus incorporating various means to produce a stream of fluid more laminar and turbulence free than has been previously possible, especially, one in which the negative effects of pump noise and ambient vibrations are minimized, for decorative, industrial or medical applications.

It is further the object of this invention to create a method and apparatus to apply a light source to such a laminar nozzle to produce a new and dramatic visual effect never before possible—one in which the stream of fluid appears to be an un-lighted, solid glass rod, but becomes an explosion of light and color whenever the stream collides with another stream or any object.

DRAWING FIGURES

REFERENCE NUMERALS IN DRAWINGS

10 Fluid Chamber
11 Inside Enclosure Means
12 Outlet Orifice
14 Laminar Fluid Output Stream
16 Fluid Level Within the Enclosures
18 Pockets of Air
20 Diffuser Means
22 Baffle
24 Light Transmitting Means
26 Fluid-Tight Clear Window
28 Light Source and Focussing Assembly Means
30 Spring Loaded Vibration Dampening Base (one or more stages)
32 Double-Walled Bladder-Like Hose
33 Valve Stem and Valve
34 Pressurized Air Chamber 36 Fluid Inlet Port

DETAILED DESCRIPTION OF THE INVENTION

Figure 1:
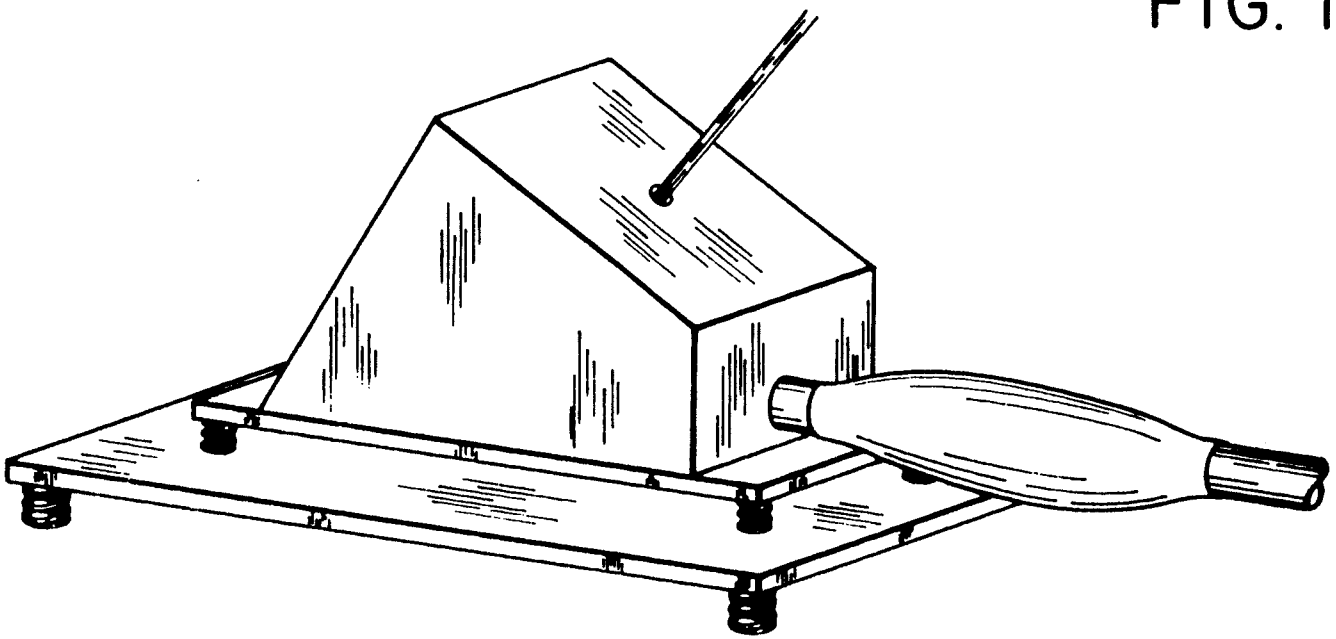
FIG. 1 is a perspective view of the present invention.

FIG. 1 is a perspective view of a typical embodiment of the present invention showing its mounting on two stages of the Spring Loaded Vibration Dampening Base (30) and emitting the Laminar Fluid Output Stream (14).

Figure 2:
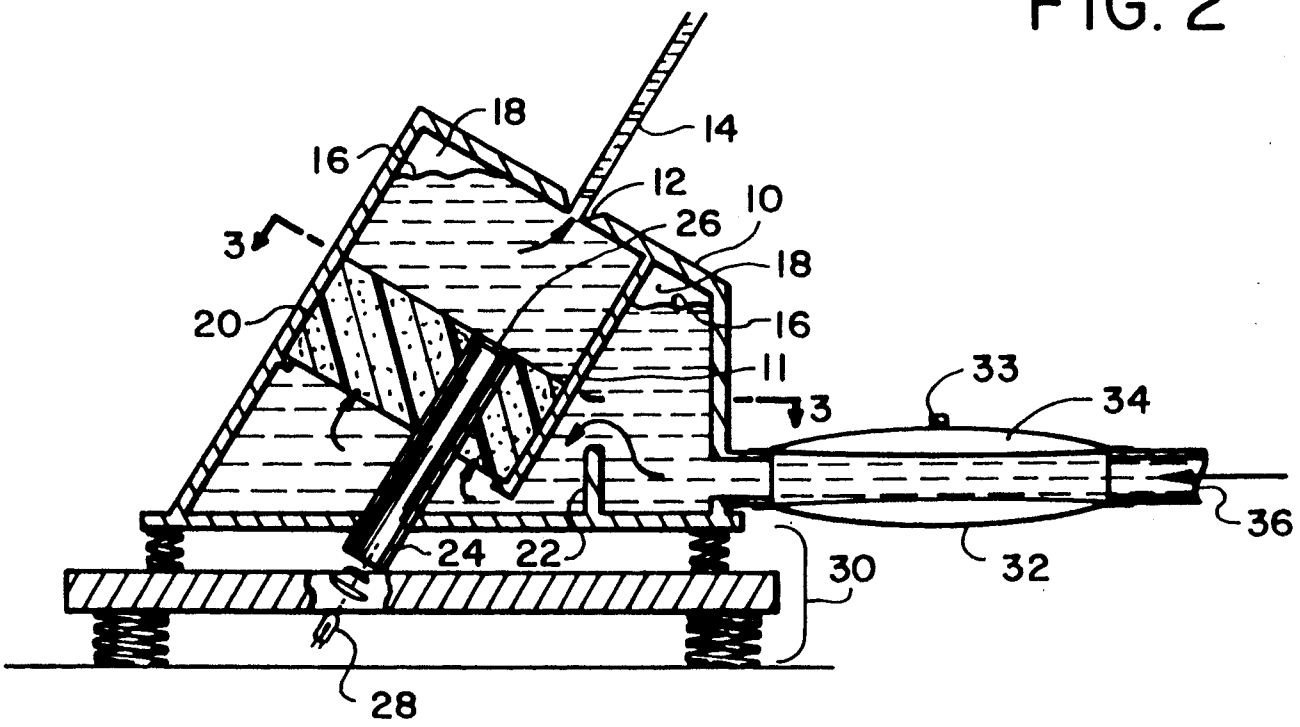
FIG. 2 is side view of the present invention showing the dual-chambered enclosure means and the fluid flow path from the input passage through the output orifice.

FIG. 2 is a sectional view of the present invention revealing an Outer Enclosure Mean (10), typically a fluid impervious enclosure made up of welded flat or curved panels of metal or plastic material to contain the pressurized fluid and provide passages means for pressurized fluid to flow from the Fluid Inlet Port (36), through the various turbulence reducing means, and out through the Outlet Orifice (12). Said Fluid Chamber is typically constructed of trapezoidal shaped panels so that substantially all the internal chambers and fluid passages are comprised of non-parallel sides. The Inside Enclosure Means (11) may be likewise constructed of flat or curved panels but is typically cylindrical in shape with some diameter d, with said Outlet Orifice located at the upper end and either co-located at the centerline of said Inside Enclosure Means (11) or, in the preferred embodiment, offset by some distance d/6 or greater from said centerline. In the preferred embodiment, said Outlet Orifice (12) has a cross-sectional area which is only a small fraction of the cross-sectional area of said Inside Enclosure Means (11). Both said Fluid Chamber (10) and said Inside Enclosure Means (11) are constructed in such a manner that said pressurized fluid will seek some natural levels, the Fluid Levels Within the Enclosures (16), to create the Pockets of Air (18) in each said enclosure. Located at the lower end of said Inside Enclosure Means (11) is a body of materials, commonly known within the art, the Diffuser Means (20), which is typically a combination of open mesh screens, open celled foam material, a parallel tube assembly or other diffusing means.

Penetrating said Diffuser Means (20), and aligned directly with the centerline of said Outlet Orifice (12) is a Light Transmitting Means (24). The purpose of said Light Transmitting Means (24) is to provide a path for light to travel from its origination at the Light Source and Focussing Assembly Means (28) into said Enclosure Means (10), through said Diffuser Means (20), terminating at a Fluid-Tight Clear Window (26), well back from said Outlet Orifice (12) but aligned so that a narrow but intense beam of light can pass through said Orifice (12), substantially congruent with the Laminar Fluid Output Stream (14). Said Light Source (28) can be of any type such as incandescent, Halogen strobe, laser, etc., white or colored. Said Focussing Assembly can consist of any combination of lenses, mirrors, fiber-optic cables, etc., to concentrate the light into a narrow path through said Light Transmitting Means (24). Said Focussing Assembly can also include colored lenses or a color wheel assembly, as is familiar to anyone practiced in the art. Said Light Transmitting Means (24) can be a hollow tube with said Fluid-Tight Clear Window (26) at the upper end to pass the light but form a fluid seal, or it can be a clear glass or plastic rod with polished ends, or a bundle of fibre optic cables, etc.

Figure 3:
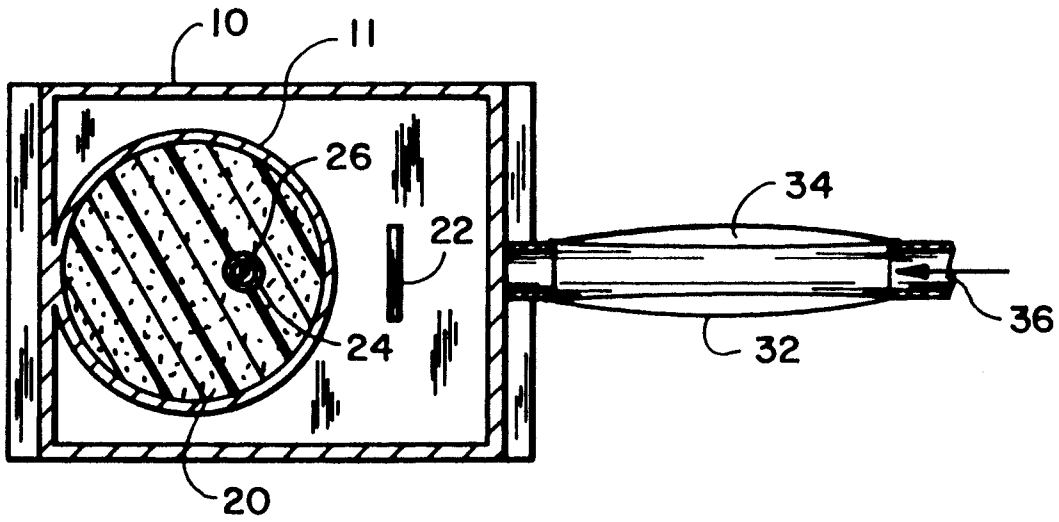
FIG. 3 is a cross sectional view of the present invention showing typical shapes of the inner and outer enclosure means and the non-centricity of the exit orifice in relation to the inner enclosure means.

FIG. 3 is a cross sectional view of the present invention showing typical shapes of the inner and outer enclosure means and the non-centricity of said Outlet Orifice (12) in relation to the inner enclosure means. Also shown is a typical size and placement of said Baffle (22).

OPERATION

FIGS. 2 and 3 The path of fluid flow through the invention is, from some external pump or other source of pressurized fluid, in through said Fluid Inlet Port (36) and then into the Double-Walled Bladder-Like Hose (32). Said Double-Walled Bladder-Like Hose (32) is a hose section made up of an inner hose of a thin bladder-like material either alone or completely surrounded by an outer hose in such a manner as to trap an air cushion, the Pressurized Air Chamber (34). The outer hose is fitted with a Valve Stem and Valve (33) to allow pressurized gas to be added or removed from said Pressurized Air Chamber (34). This soft, inflated double hose assembly serves two important functions for reducing turbulence: First, it isolates the present invention from pump and other vibration which would otherwise be transmitted directly by means of a rigid hose and, second, it serves to absorb or accumulate small pressure variations, "pump noise", usually present in any input stream. In practice, the actual air pressure in said Pressurized Air Chamber (34) can be adjusted to "tune" the assembly for maximum vibration dampening for any given input stream. Next the fluid flows into said Outer Enclosure Means (10) where the forward current is broken up by the Baffle (22) and further dampened for pump noise by the first said Pockets of Air (18). In practice, it can be shown that ambient vibrations and minute pressure variations can be most effectively transmitted in a fluid medium when the fluid is flowing along a passage with parallel side walls. Conversely, such vibrations are not transmitted as efficiently through passages where the side walls are not parallel. Therefore, in the preferred embodiment of the present invention, flat, parallel enclosure walls are avoided wherever possible. The fluid flows next into the lower end of said Inside Enclosure Means (11) and into said Diffuser Mean (20). Said Diffuser Means (20), most easily seen in the cross-sectional view, FIG. 3, provides a very large plurality of parallel fluid paths to dampen all remaining major currents by lowering the fluid velocity, and thus the Reynolds number, in a manner that is well known to anyone familiar with the art. The preferred embodiment for the Inside Enclosure Means (11) would likely be a trapezoidal box but we have, nevertheless, shown it as a cylinder in FIGS. 2 and 3. This is because the use of a cylinder greatly facilitates ease of construction. Therefore, we must address the matter of vibrations or "standing waves" which might be transmitted up through said Inside Enclosure Means (11) and out through said Outlet Orifice (12) in the form of turbulence. As may be empirically shown by tapping a spoon on a full water glass, vibrations or standing waves in fluid in a cylindrical shaped vessel often tend to be additive and, consequently, have maximum effect at the center of the cylinder and tend to be at a minimum or null about one-sixth of the diameter away from the center line of the cylinder. Consequently, in any embodiment using a cylinder for said Inside Enclosure Means (11) said Outlet Orifice (12) is located at some distance offset from the centerline of said Inside Enclosure Means (11), usually d/6. The second Pockets of Air (18) will tend to absorb any remaining pressure variations in the fluid stream.

Another source of turbulence in the output stream of most prior art nozzles is from ambient vibrations from floors or passing traffic which tends to be transmitted from the mounting base, through the nozzle body and out with the output stream. For non-laminar streams or even laminar streams which are not lighted, this effect is seldom noticeable. However, for the desired effect of the present invention such minute turbulence will tend to make ripples in the outer skin of said Laminar Output Stream (14) which transmit light and spoil the effect. Therefore, the present invention utilizes a Spring Loaded Vibration Dampening Base (30) to absorb such ambient vibrations. In the preferred embodiment, the springs are selected to have a natural harmonic rate, with the mass of the fluid filled nozzle body, the present invention, significantly different from that of the most prevalent ambient vibration. In some cases, particularly where multiple nozzle bodies, the present invention, are mounted together, it is practical and desirable to incorporate two stages of Spring Loaded Vibration Dampening Base (30) for maximum dampening effect. In that case the springs for the second stage are selected to produce a natural harmonic frequency significantly different from both the ambient vibration and the first stage.

SUMMARY, RAMIFICATIONS AND SCOPE

Although the description above contains many specifications, these should not be construed as limiting the scope of the invention but as merely providing illustrations of some of the presently preferred embodiments of this invention. For example, an alternate embodiment of the present invention may be to provide a fluid medium for transmitting ultrasound pulses for industrial testing applications. Another might be to apply a fluid coating to a mechanical surface with minimal splashing and waste (i.e. airplane wing de-icing). Another might be to use the internal lighting of the stream to precisely target the delivery of the fluid stream (i.e. fire fighting, medical).

Thus the scope of the invention should be determined by the appended claims and their legal equivalents, rather than by the examples given.

We claim:

1. In a laminar-flow fluid nozzle, the combination of a fluid chamber having one substantially knife edged outlet orifice, an inlet port connected to a wall of said fluid chamber, a diffuser means disposed within said chamber between said inlet port and said outlet orifice, said outlet orifice being located on one wall of said fluid chamber such that the distance from said outlet orifice to any adjacent side wall of said fluid chamber is substantially different from the distance to any other adjacent side wall, whereby the non-centered location of said outlet orifice functions to dampen the effect of pump surges and vibration and thereby increases the laminarity of the output stream emanating from said outlet orifice.

2. In a laminar-flow fluid nozzle, the combination of a fluid chamber having a substantially knife edged outlet orifice, an inlet port connected to a wall of said fluid chamber, a diffuser means disposed within said chamber between said inlet port and said outlet orifice, said fluid chamber being mounted on three or more shock absorbing springs whereby said fluid chamber is isolated from vibration in order to increase the laminarity of the output stream emanating from said outlet orifice.

3. In a laminar-flow fluid nozzle, the combination of a fluid container having a substantially knife edged outlet orifice, an inlet port connected to a wall of said fluid chamber, a diffuser means disposed within said chamber between said inlet port and said outlet orifice, said fluid chamber being of a shape such that one or more pockets of air are permanently trapped within, said pockets constituting a substantial portion of the total volume of said fluid chamber, and wherein, said pockets of air function to increase the laminarity of the output stream emanating from said outlet orifice by absorbing pump surges and vibration.

4. In a laminar-flow fluid nozzle, the combination of a fluid chamber having a substantially knife edged outlet orifice, an inlet port connected to a wall of said fluid chamber, a diffuser means disposed within said chamber between said inlet port and said outlet orifice, a double-walled bladder-like fluid supply hose connected to said inlet port with a dead air space entrapped between the outer wall and inner wall of said hose, a valve being disposed on said outer wall for adding or removing air from said dead air space, wherein said double-walled bladder-like fluid supply hose functions to absorb pump surges and vibration and increase the laminarity of the output stream emanating from said outlet orifice.

* * * * *